US011581104B2

(12) United States Patent
Choi et al.

(10) Patent No.: US 11,581,104 B2
(45) Date of Patent: Feb. 14, 2023

(54) MULTI-LAYER STRUCTURE OF NUCLEAR THERMIONIC AVALANCHE CELLS

(71) Applicant: UNITED STATES OF AMERICA AS REPRESENTED BY THE ADMINISTRATOR OF NASA, Washington, DC (US)

(72) Inventors: Sang Hyouk Choi, Poquoson, VA (US); Dennis M. Bushnell, Hampton, VA (US); Adam J. Duzik, Rockledge, FL (US)

(73) Assignee: UNITED STATES OF AMERICA AS REPRESENTED BY THE ADMINISTRATOR OF NASA, Washington, DC (US)

( * ) Notice: Subject to any disclaimer, the term of this patent is extended or adjusted under 35 U.S.C. 154(b) by 440 days.

(21) Appl. No.: 16/880,351

(22) Filed: May 21, 2020

(65) Prior Publication Data

US 2020/0373035 A1 Nov. 26, 2020

Related U.S. Application Data

(60) Provisional application No. 62/850,624, filed on May 21, 2019.

(51) Int. Cl.
*G21H 1/10* (2006.01)
*G21H 1/04* (2006.01)

(52) U.S. Cl.
CPC ..... *G21H 1/106* (2013.01); *G21H 1/04* (2013.01)

(58) Field of Classification Search
CPC ..... G21H 1/106; G21H 1/04
(Continued)

(56) References Cited

U.S. PATENT DOCUMENTS 7,417,356 B2 * 8/2008 Luo ..... G21H 1/02 310/305
10,269,463 B2 * 4/2019 Choi ..... G21H 1/103
(Continued)

OTHER PUBLICATIONS

Dapor, M. "Application of the Monte Carlo Method to Electron Scattering Problems", Jan. 25, 2015, pp. 1-59.
(Continued)

*Primary Examiner* — John K Kim
(74) *Attorney, Agent, or Firm* — M. Bruce Harper; Robin W. Edwards; Helen M. Galus

(57) ABSTRACT

The present disclosure is directed to nuclear thermionic avalanche cell (NTAC) systems and related methods of generating energy from captured high energy photons. Huge numbers of electrons in the intra-band of atom can be liberated through bound-to-free transition when coupled with high energy photons. If a power conversion process effectively utilizes these liberated electrons in an avalanche form through a power conversion circuit, the power output will be drastically increased. The power density of a system can be multiplied by the rate of high energy photon absorption. The present disclosure describes a system and methods built with multilayers of nuclear thermionic avalanche cells for the generation of energy. The multilayer structure of NTAC devices offers effective recoverable means to capture and harness the energy of gamma photons for useful purposes such as power systems for deep space exploration.

21 Claims, 12 Drawing Sheets
(11 of 12 Drawing Sheet(s) Filed in Color)

(58) Field of Classification Search
USPC ..... 310/305
See application file for complete search history.

(56) References Cited

U.S. PATENT DOCUMENTS

| | | | | |
|---|---|---|---|---|
| 10,985,676 | B2 * | 4/2021 | Choi | H02K 99/00 |
| 2008/0272680 | A1 | 11/2008 | Perreault | |
| 2013/0125963 | A1 | 5/2013 | Binderbauer et al. | |
| 2016/0225476 | A1 * | 8/2016 | Choi | G21H 1/04 |
| 2019/0288614 | A1 * | 9/2019 | Choi | G21H 1/12 |
| 2020/0373035 | A1 * | 11/2020 | Choi | G21H 1/106 |
| 2021/0242810 | A1 * | 8/2021 | Choi | H02N 3/00 |

OTHER PUBLICATIONS

Oakley, W.S, "Resolving the Electron-Positron Mass Annihilation Mystery", Int. Journal of Scientific Rep. Oct. 2015, pp. 250-252, vol. 1, No. 6.

"Energies of a photon at 500 keV and an electron after Compton scattering", https://commons.wikimedia.org/wiki/File:ComptonEnergy.jpg, accessed Feb. 9, 2022, pp. 1-3.

Johns, H.E. et al., "Electron Energy Distributions Produced by Gamma-Rays", Table 2a, Nucleonics, Oct. 1954, pp. 40-56. vol. 12, No. 10.

McMullan G. et al., "Experimental observation of the improvement in MTF from backthinning a CMOS direct electron detector", Ultramicroscopy, Aug. 2009, pp. 114-1147, 109 (9-3).

Sze, S.M. at el., "Physics of Semiconductor Devices", 3rd Ed., Wiley Interscience, 2007, p. 154, ISBN-13:978-0-471-14323-9.

Berger, M.J , et al., "XCOM: Photon Cross Sections on A Personal Computer", U.S. Department of Commerce, Jul. 1987, 30 pages, NBSIR 87-3597.

Rapach, T.A. et al., "Gamma Ray Spectroscopy", (2008). pp.1-4.

* cited by examiner

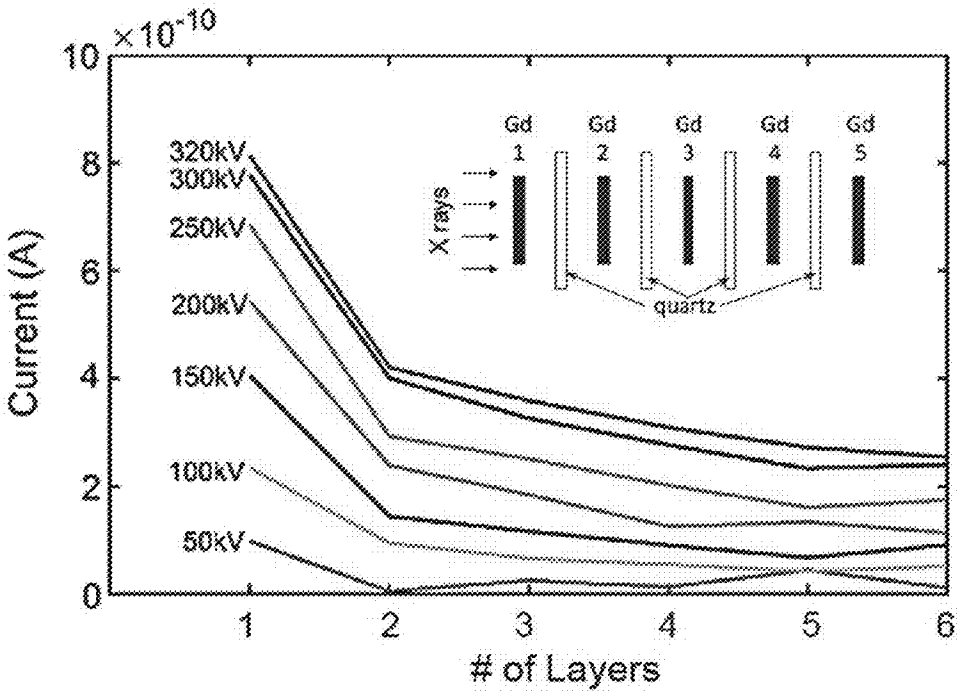
FIG. 10
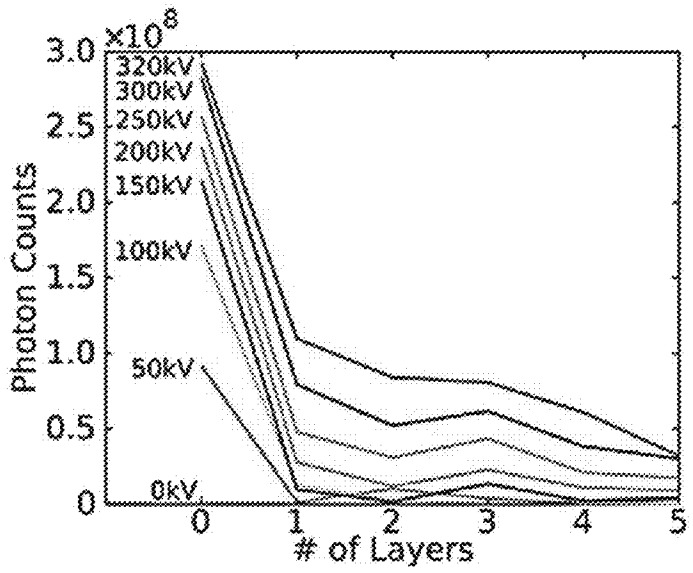

MULTI-LAYER STRUCTURE OF NUCLEAR THERMIONIC AVALANCHE CELLS

CROSS-REFERENCE TO RELATED PATENT APPLICATION

This patent application claims the benefit of and priority to U.S. Provisional Patent Application No. 62/850,624, filed on May 21, 2019, the contents of which are hereby incorporated by reference in their entirety.

STATEMENT REGARDING FEDERALLY SPONSORED RESEARCH OR DEVELOPMENT

The invention described herein was made by employees of the United States Government and may be manufactured and used by or for the Government of the United States of America for governmental purposes without the payment of any royalties thereon or therefore.

BACKGROUND OF THE INVENTION

Conventional nuclear batteries, nuclear capacitors, or similar nuclear power generation systems rely upon nuclear fission induced by the collision of two subatomic particles. Generally, a subatomic particle, typically a neutron, is absorbed by the nucleus of a fissile material that fissions into two lighter elements and additional neutrons along with releases of thermal energy and prompt gamma rays. The fissile material in some cases can be a material such as uranium-235. Conventional and prior art systems, however, fail to capture the energy of other particles and prompt gamma ray released during fission. The current disclosure describes methods and systems for the effective absorption or capture of isotope-emitted beta particles and high energy photons to maximize the power output. The methods and systems disclosed herein result in a more efficient means to produce power as effective absorption or capture of these high energy subatomic particles and high energy photons that determine more power density of energy conversion systems.

Prior art energy systems include nuclear batteries described in U.S. Pat. No. 10,269,463, hereby incorporated by reference in its entirety. Methods and systems disclosed herein improve the energy conversion, production, and efficiency of Nuclear Thermionic Avalanche Cell (NTAC) related systems. Prior art energy systems using a NTAC are described in U.S. Pat. No. 10,269,463, the contents of which are hereby incorporated by reference in their entirety. The novel configuration and design of the NTAC disclosed herein takes advantage of an isotope's multiple internal interactions via a uniquely designed multiple layered structure of the NTAC. The unique design disclosed herein results in an energy conversion and power generation system with extremely high power density output. The systems and methods disclosed herein would only require refueling every three to four decades (depending on the application and activity rate of fission) or perhaps longer. Such functionality could be attractive in applications where the energy-using device is very remote from energy refueling sources or where there are operational benefits associated with minimal refueling. Potential applications include use in drones, high altitude aircraft, public utility-scale electric power generation facilities, electric propulsion for automobiles and airplanes, power for remote and rural communities, nodal power without transmission lines, marine electric-propulsion onboard nautical vessels, spacecraft, and satellites.

BRIEF SUMMARY OF THE INVENTION

The present systems and methods disclosed herein are directed to nuclear thermionic avalanche cell (NTAC) system that may include a radioisotope core that may be configured to emit high energy photons and energetic beta particles and the radioisotope core may be substantially cylindrical-shaped or rod-shaped. In some examples, the avalanche electron emitter layer may surround an outer portion of the radioisotope core and a plurality of NTAC layers may surround the radioisotope core. In other examples, the plurality of NTAC layers may be substantially cylindrical-shaped and the plurality of NTAC layers may further include a collector, an insulator, and an emitter. In still other examples, the emitter layer encapsulating a radioisotope core and the NTAC layer emitter may be positioned across a thermionic vacuum gap to face the collector. In some examples, the collector may be positioned across a thermionic vacuum gap, and the collector, the insulator, and the emitter may be integrated with each other. In still other examples, the collector may be configured on an interior of the insulator and the insulator may be configured on an interior of the emitter. In yet other examples, the plurality of NTAC layers may form a coaxially arranged and multilayered NTAC, and the emitter encapsulating or surrounding a radioisotope core and the NTAC emitter layers may be configured to capture the photons from the radioisotope core, and by the captured photons free up a large number of electrons in an avalanche process from deep and intra-band of atoms. In another example, the large number of avalanche electrons that are emitted from the emitter may pass through the thermionic vacuum gap and arrive at the collector to output a high density avalanche cell current through a photo-ionic or thermionic process of the freed up electrons.

In other examples, the radioisotope core may have a diameter and a height that are dependent on the design of the NTAC system according to power requirement. In another example, the photons may be X-rays, gamma rays, or visible UV light and the radioisotope core may be Cobalt-60, Sodium-22, or Cesium-137. In yet another example, a required number of NTAC layers may be determined by the complete absorption and exhaustion of high energy photons undergoing the electron avalanche process through each of the plurality of NTAC layers.

A certain amount of the photons is absorbed by a single layer of NTAC and the rest of the photons goes to and couples with the next layer of NTAC. Any left-over of photons that pass through prior NTAC layers keep progressing to and interacting with the next NTAC layer for power generation. The photon energy determines the mean-free-path. How far a photon penetrates into a material is explained by the mean-free-path. The mean-free-path is determined by the photon energy and normally atomic number. The higher the photon energy is, the longer the mean-free-path is. And higher the atomic number is, the shorter the mean-free-path is. Therefore, the required number of NTAC layers is determined by the photon energy and the atomic numbers of materials for the emitter, the collector, and the insulator.

In another example, the emitter may comprise a nanostructured surface of a high Z material and the emitter may capture photons from the radioisotope core, and the collectors may be configured to capture avalanche electrons from the emitters and lead avalanche electrons to a power circuit.

In still other examples, the collector may comprise a low or mid Z material. In one example, the emitter may have a thickness from about 1 mm to about 3 mm. In another example, the emitter may have a thickness of at least 1 mm. In yet another example, the photons from x-rays, gamma rays, or visible UV light may be absorbed by the emitters and collectors and may be converted into thermal energy through inelastic collisions and scattering, and/or the avalanche electrons may undergo multiple Coulomb collisions with neighboring electrons generating thermal energy. In still other examples, a thermoelectric generator may be configured to receive the thermal energy and output thermoelectric power.

Another embodiment disclosed herein is a method of capturing high energy photons to generate power that may include receiving high energy photons emitted from a radioisotope core integrated with a nuclear thermionic avalanche cell (NTAC), in which the NTAC may comprise a plurality of NTAC layers configured to receive the photons, and the NTAC layer may include an emitter, a thermionic vacuum gap, and a collector, In some examples, the emitter may be positioned between the radioisotope core and the collector. The method, in other examples, may include outputting the liberated avalanche electrons using the received photons, guiding the avalanche electrons to cross over a vacuum gap to a collector, harnessing a load from the electrons at the collector via a power circuit, and generating an electrical current.

In some examples, the radioisotope core of the method may further include an emitter layer, a thermionic vacuum gap, and a collector layer. In other examples, the high-energy photons may be X-rays, gamma rays, or visible UV light. In some example methods, the radioisotope core may be Cobalt-60, Sodium-22, or Cesium-137. In yet other example methods, the emitter may have a thickness from about 1 mm to about 3 mm, and the radioisotope emitter may have a thickness about 1 mm. In another example, the emitter may have a thickness of at least 3 mm. In still other example methods, the emitter may include a nanostructured surface of a high Z material. In still other example methods, the collector may comprise a low or mid Z material.

Yet another embodiment disclosed herein is an energy conversion system comprising a radioisotope core configured to emit high energy photons, and the radioisotope core may comprise Cobalt-60, Sodium-22, or Cesium-137. In other examples, a nuclear thermionic avalanche cell may comprise a plurality of NTAC layers integrated with the radioisotope core and configured to receive the photons from the radioisotope core and by the received photons free up a large number of electrons in an avalanche process from deep and intra-bands of an atom to output a high density avalanche cell current through a photo-ionic or thermionic process of the freed up electrons, and the avalanche current may be fed through power circuit. In some examples, the plurality of NTAC layers may comprise a nanostructured surface of a high Z material, the plurality of NTAC layers may comprise a combination of a collector in which the collector may be at least 1 mm thick, an insulator that may be at least 3 mm thick, and an emitter that may be at least 3 mm thick. In one particular example, a thermoelectric generator may be configured to receive the thermal energy, and the thermal energy may be radiatively conducted axially and radially, and the thermoelectric generator may output thermoelectric power. In other examples, the thermoelectric generator may surround the plurality of NTAC layers and the radioisotope core.

These and other features, advantages, and objects of the present approach will be further understood and appreciated by those skilled in the art by reference to the following specification, claims, and appended drawings.

BRIEF DESCRIPTION OF THE SEVERAL VIEWS OF THE DRAWINGS

The patent or application file contains at least one drawing executed in color. Copies of this patent or patent application publication with color drawings will be provided by the Office upon request and payment of the necessary fee.

FIG. 10 graphically depicts the measured data of X-ray absorption through multiple gadolinium plates. The right graph depicts X-ray photon liberated electron currents measured from gadolinium plates.

DETAILED DESCRIPTION OF THE INVENTION

It is to be understood that the systems and methods disclosed herein may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The systems and methods disclosed herein relate a system, and related methods of generating power, constructed with multilayers of nuclear thermionic avalanche cells (NTAC). The multilayer structure of NTAC systems offers effective recoverable means to capture and harness huge quantities of energy from gamma photons for useful purposes, such as a power source for deep space exploration.

High energy photons have well-defined interactions with the electrons and the nucleus of an atom, such as photoelectric (pe), photonuclear (pn), Compton scattering (Cs), and electron/positron pair production (pp). Large number of electrons in the intra-band of atom can be liberated through bound-to-free transition when coupled with high energy photons. If a power conversion system or process effectively utilizes these liberated electrons in an avalanche form through a power conversion circuit, the power output will be drastically increased. As such, the power density of the system can be multiplied by the rate of high energy photon absorption. Long mean free-paths of high energy photons, however, experience some attenuation of light travelling through the materials by absorption and scattering. Enhancing the coupling effect or absorption of high energy photons requires a thicker material than the mean free-path, or a sufficient number of layer structures of energy conversion devices must be implemented to capture the flux of high energy photons.

Figure 1:
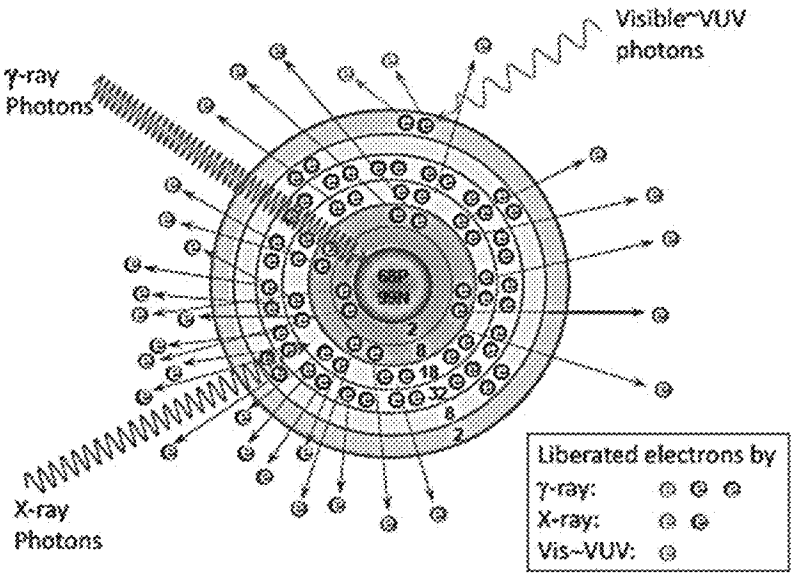
FIG. 1 depicts liberated or released electrons of an atom interact with high energy photons.
Figure 2:
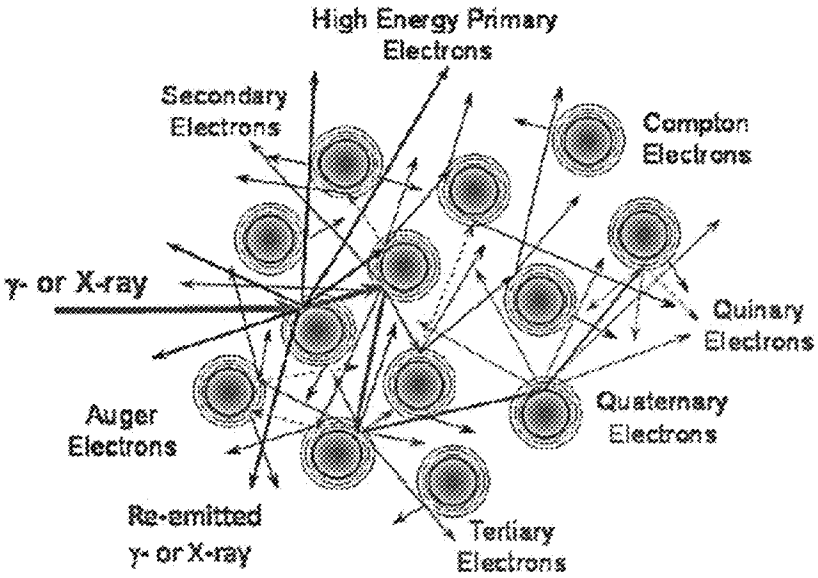
FIG. 2 depicts multiple interactions of high energy photons with surrounding atoms.

NTAC systems (see e.g., U.S. Pat. No. 10,269,463 titled "Nuclear Thermionic Avalanche Cells with Thermoelectric (NTAC-TE) Generator in Tandem Mode") employ high-energy gamma rays (tens of keV to MeV) to liberate or free a large number of intra-band, inner shell electrons from atoms for power generation through the primary interactions of photoelectric, Compton scattering, photonuclear, and electron/positron pair production processes ad illustrated in FIGS. 1 and 2. The large number is in relative contrast to the maximum of three electrons in the valence band, as used by alternate approaches or systems. The high energy photons easily knockout the electrons in K-edge and L-edge of high Z materials. For example, the absorption band edges of K and L shells of rhenium (Re) are 71.676 keV and 35.016 keV, respectively [2]. Gold, for example, requires 80.723 keV to remove the K-band edge electron and 40.004 keV for L-band edge [2]. As shown in FIG. 2, the secondary interactions result from (1) the scattered γ-rays through Compton scattering (see Compton γ-ray in FIG. 3); (2) high energy carrying electrons by either photoelectric or Compton effect (see energetic electron in FIG. 3); (3) fluorescent emission of X-ray photons and Auger electron emission while L-band edge or higher band electron fills the vacancy state in K-shell (see FIG. 4); and (4) the two γ-ray photons (511 keV) emissions through the annihilation of electrons/positrons, as shown in FIG. 5 [3]. The "large number" means that the total number of electrons liberated from an atom are "avalanche electrons" and is the summation of the electrons liberated from the inner shells of atom, in addition to the electrons from the outer-most shell of atom. For example, the maximum extractable number of electrons from Lanthanum is counted by the electrons ($10^5$ Coulomb/cm$^3$) liberated from their intra-band in the inner-shell of La atom and the electrons ($10^3$ Coulomb/cm$^3$) from the outer-most shell. The conventional alternative energy conversion processes have used only the electrons ($10^3$ Coulomb/cm$^3$) from the outer-most shell of an atom. In contrast, NTAC uses the electrons ($10^5$ Coulomb/cm$^3$) not only from the intra-band in the inner shells, but also from the outer-most shell of atom. The majority of electrons are liberated from the intra-band in the inner shells of an atom, in addition to the electrons from the outer-most shell of an atom. Thus, the number of electrons used in NATC is at least two (2) orders of magnitude higher than that in the conventional approaches.

In a collision of a gamma ray of energy E with an electron, the gamma ray energy E', after scattering through angle θ, is given by:

$$E' = \frac{E}{1 + \frac{E}{mc^2}(1 - \cos\theta)}.$$

Figure 3:
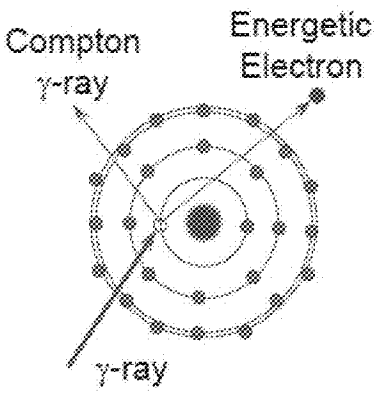
FIG. 3 depicts energetic electron and scattered Compton γ-ray.

For very small scattering angles, the gamma ray energy does not change much since the factor (1−cos θ) is approximately zero, and the denominator of the above equation is nearly unity. The above equation for E=500 keV γ-photon yields the electron with 160 keV and photon with 340 keV energies after Compton scattering with a 45° collision angle [4]. Based upon this result, it is observed that the scattered Compton γ-ray carries substantial photon energy, which has similar effects of photoelectric, Compton scattering, photonuclear, and electron/positron pair production processes as the primary γ-photons as depicted in FIGS. 2 and 3.

Figure 6:
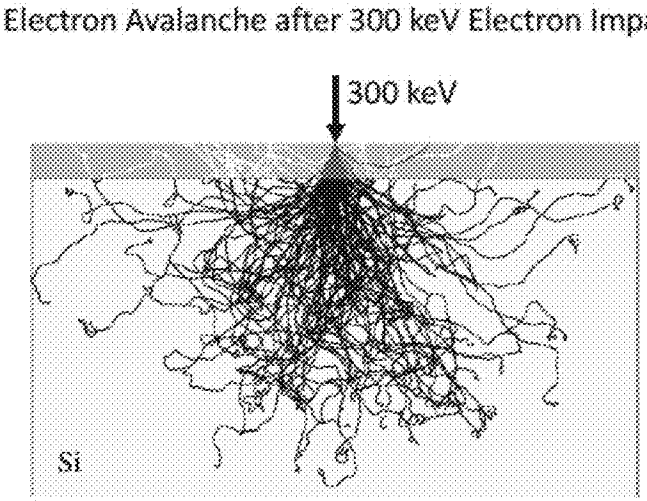
FIG. 6 illustrates electron avalanche in Si after 300 keV electron impact.

The removing K-band edge electron of high-Z materials requires less than 140 keV [2]. Photoelectron or Compton electron, therefore, after an interaction with a photon with a higher than K-band edge gains substantial energy due to the difference between photon energy and K-band edge. For example, a γ-ray photon of Cs-137 (662 keV) on rhenium, the photoelectron or Compton electron gains 590 keV by (photon 662 keV−K-band edge 71.676 keV). A study based on the Monte Carlo method shows that the photoelectron carries 300 keV after interacting with γ-photon=600 keV [5]. As shown in FIG. 6, the liberated intra-band electrons, still carrying high energy above the energy of K-band edge, undergo free-to-free transition through either emission across a vacuum gap, or to Coulomb collision with electrons of neighboring atoms that, consequently, creates avalanche electrons in a low energy state. The electrons created in an avalanche mode as a single event almost instantaneously undergo a recombination process by releasing low energy photons (some of these low energy photons are recognized as a scintillation or Bremsstrahlung). When continuous interactions with incident high energy photons are sustained as multiple and continuous events that exceed the recombination process in time and energy, however, the avalanche state of liberated electrons through the secondary interactions with high energy primary electrons will be sufficiently held to an equilibrium level.

Figure 4:
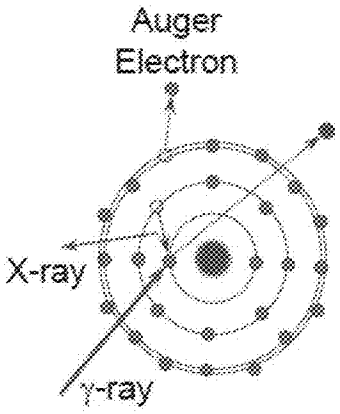
FIG. 4 depicts emission of X-ray by K-edge refilling and Auger electron.
Figure 5:
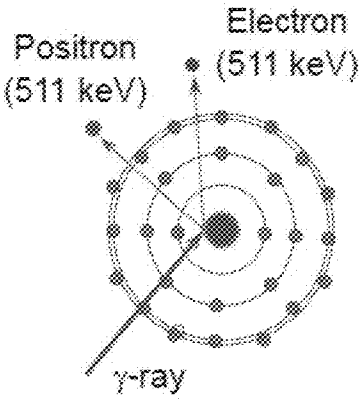
FIG. 5 depicts electron/positron pair production.
Figure 7:
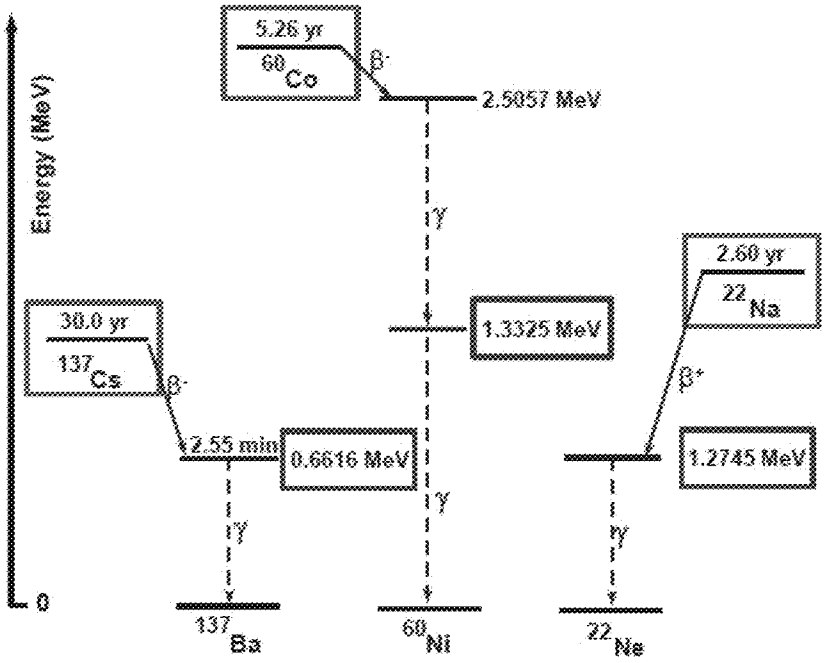
FIG. 7 graphically depicts energy of Gamma ray sources.

As depicted in FIG. 4, there will be a fluorescent X-ray emission while an L-band edge or higher band electron fills the vacancy state in the K-shell. Rhenium, for example, includes a pair of emissions anticipated at $K_{\beta 1}$=69.298 keV and $L_{\beta 1}$=10.008 keV, or at $K_{\alpha 1}$=61.131 keV and $L_{\alpha 1}$=8.651 keV [2]. The energy of these fluorescent X-ray emissions is still large enough to shake-up or knockdown electrons at the L-band edge or higher (i.e., M, N, etc.) into free-to-free transition mode at the surface and within vacuum gap.

For photons with high photon energy (i.e., several MeV scale and higher), pair production eventually becomes the dominant mode of photon interactions with matter. As shown in FIG. 5, when the photon is near and ties up with an atomic nucleus in resonant mode, the energy of the photon may be converted into an electron/positron pair. When an electron collides with a positron, the annihilation of electron and positron occurs and generates two γ-ray photons [3]. The two γ-photons generated from electron/positron annihilation have at least 511 keV at 180° as the minimum energy that interacts with electrons of a neighboring atom to be liberated. All four aspects of γ-ray photon interactions with matter described above show the primary (i.e., direct interaction) and secondary (i.e., indirect) contributions to liberation of electrons from the intra-band of an atom. If several MeV photons are used, there would be more complex interactions such as tertiary, quaternary, and quandary; all of which would be additive to liberate and release the intra-band electrons.

Exothermic nuclear reactions, through decay and fission, generate keV to MeV X-ray and γ-ray photons which are suitable for NTAC applications. A half-life of the decay process can be a tens of years or more. Thus, a single NTAC charge can run for decades without refueling. Further, nuclear waste refinement can provide a stable, ready supply of γ-ray emitting materials. For example, Cs-137 is an abundant component (6%) of nuclear waste, with a 30.23 year half-life and strong emissions at 662 keV; Co-60 is readily produced in a nuclear reactor by bombarding Co-59 with thermal neutrons. Na-22 requires a cyclotron collision process of proton to magnesium or aluminum target to generate Na-22. From the current stockpile of radioactive materials, the supply of gamma ray sources for NTAC devices does not pose any significant issue.

Through the photoelectric (pe) and photonuclear (pn) effects, Compton scattering (Cs), and electron/positron pair production (pp) the absorbed energy is proportional to the absorption cross-section ($\sigma_t=\sigma_C+\sigma_{pe}+\sigma_{pn}+\sigma_{pp}$), the atomic number of matter (Z), and the thickness of the materials in the primary interaction. As shown in FIG. 1, γ rays can penetrate an electron band structure of an atom into its nucleus disrupting the shell electrons from their probability space. Moreover, γ rays also interact with intra-band electrons directly, liberating secondary and tertiary electrons in the avalanche process.

As an example, the number of lanthanum (La) atoms per gram is $4.33\times10^{21}$/g or $2.67\times10^{22}$/cm$^3$. Assuming that 29 of 57 La electrons are stripped off as avalanche electrons, the energy required to strip off 29 out of La atom would be less than 17.641 keV for L-edge and 38.925 keV for K-edge electrons [2]. Thus, the number of available electrons per cm$^3$ is $7.74\times10^{23}$/cm$^3$, or 124,042 C/cm$^3$ ($\approx10^5$ C/cm$^3$ or $\approx10^7$ C/kg), 5 orders of magnitude higher in energy density than conventional systems based on free or dopant density-dependent valence band electrons only. As shown and described in FIG. 8, a set of governing equations are derived reflecting the bound-to-free and free-to-free quantum level transitions of intra-band electrons.

Figure 8:
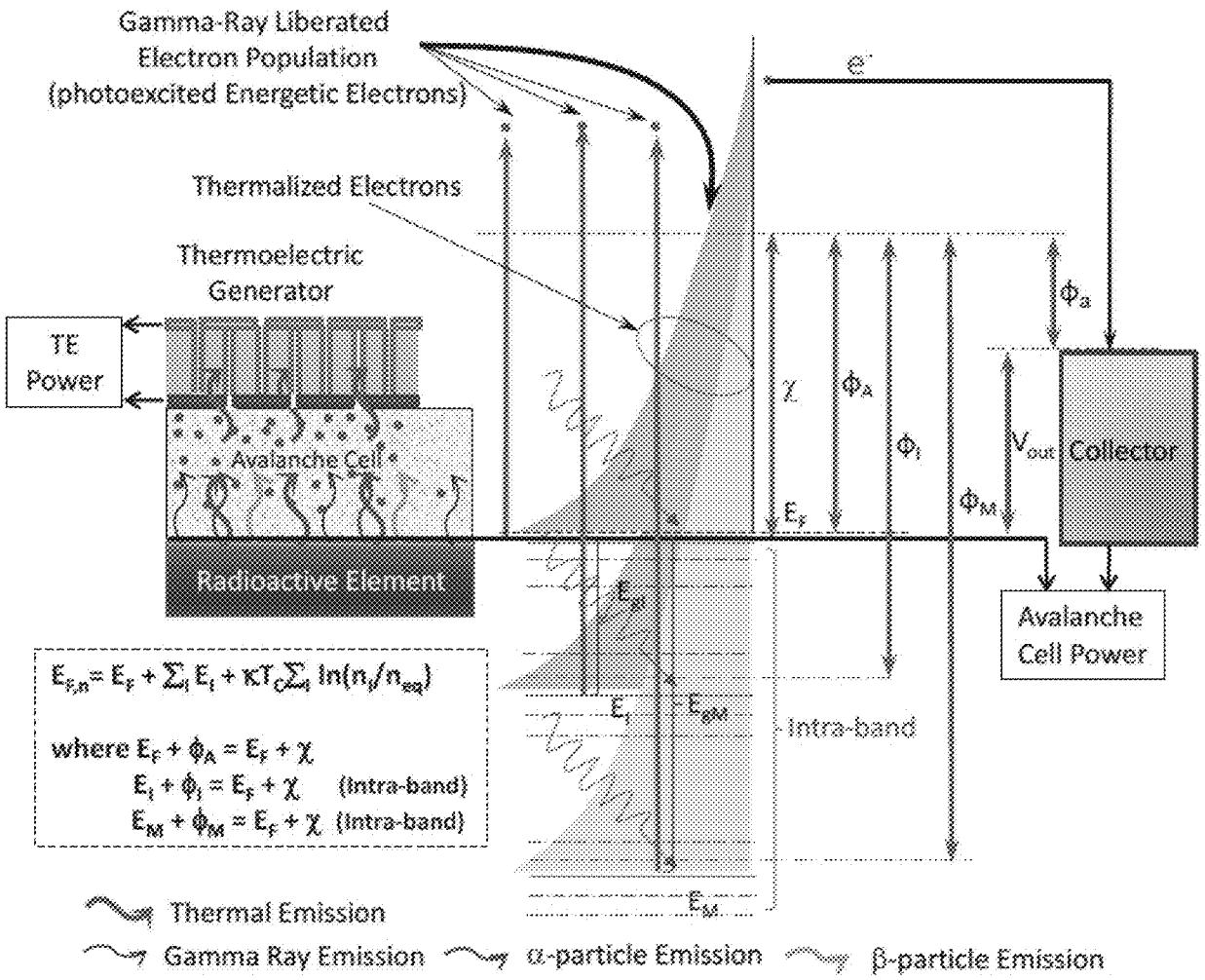
FIG. 8 illustrates an energy diagram of photoexcitation and thermalization processes. Photoexcitation and thermalization processes initiated by gamma-ray and beta particles from radioactive materials increase the conduction band (or liberated electrons) population, creating a large thermionic current. The thermal energy generated by radioactive coupling and decaying processes is converted by the metallic junction TE device in a tandem mode. This model is still valid for secondary, tertiary, and quaternary interactions of high energy photons.

The high energy photon-enhanced thermalized avalanche electron emissions can be estimated by considering the flux of photo-excited, Coulomb collision, and photo-thermalized electrons that have sufficient energy to escape the material surface. The flux of electrons is the collection of electrons freed up and undergone free-to-free transition from the deep level and intra-band photo excitations by a MeV level photon energy. The electron population in the conduction-band is distributed by the quasi-Fermi level in the aftermath of the level transitions from the deep and intra-bands impacted by high energy photon fluxes. FIG. 8 illustrates the level transitions from the deep and intra-bands. The electrons freed from the deep and intra-bands, $\Sigma E_J$, are simultaneously populated above the level of conduction-band minimum, $E_C$, and gain further energy through thermalization and photoexcitation processes. From statistical physics, the density of particles can be written as $\Sigma_i\Sigma_j n_i(E_j)=\Sigma_i\Sigma_j g_i(E_j)f_i(E_j)$ where $\Sigma_j g_i(E_j)$ is density of states determined by the band-edges (j=K, L, M, N, O) within the excitation mechanisms (i=Compton, Energetic, Fluorescent, and Pair) and likewise $\Sigma_j f_i(E_j)$ is the probability for a taken state j with energy E for respective excitation mechanism i.

The Fermi energy of number of electrons is expressed [7] by $$E_{F,n_{i,j}} = E_F + \sum_i \sum_j E_{i,j} + \kappa T_C \sum_i \sum_j \ln\left(\frac{n_{i,j}}{n_{eq}}\right) + k \sum_i \sum_j n_{i,j} T_{i,j} \quad (1)$$

where $E_F$ is the Fermi level, $E_{i,j}$ is the Fermi level of intra-band under $i^{th}$ excitation mechanism, $n_{i,j}$ is the total freed-up electron concentration in the conduction band from an intra-band at $i^{th}$ excitation mechanism, $n_{eq}$ is the equilibrium concentration without photoexcitation, and $T_C$ is the cathode temperature. From the above expression, it is obvious that the photoexcitation by gamma ray abundantly multiplies electron concentration at the conduction-band additively from the valence band and intra-bands, $\Sigma\Sigma E_{i,j}$. The third term of Eq. (1) represents the thermionic emission of electrons at surface temperature ($T_C$). The fourth term represents the photo-excited energetic electrons at the conduction band. Eq. (1) is also applicable to the primary, secondary, tertiary, etc., interactions for determining the Fermi energy of the number of electrons in emission from the emitter material.

Assuming the freed-up electrons are collected by the collector cathode, the total current density can be expressed by $$J_C = \int_{E_C+\chi}^{\infty} e v_x \sum_i \sum_j N_i(E_j) f_i(E_j) dE = \int_{E_C+\chi}^{\infty} e v_x \left(\frac{4\pi(2m^*)^{\frac{3}{2}}}{h^3}\right) \sum_i \sum_j \left(\sqrt{E_{i,j}-E_C} \cdot \exp\left(\frac{-E_{i,j}+E_{F,n_{i,j}}}{\kappa T_C}\right)\right) dE \quad (2)$$

where $E_C$ is the energy at the conduction-band minimum, χ the electron free-to-free transition in average, e the electron charge, $v_x$ the electron velocity perpendicular to the material surface, $\Sigma_i\Sigma_j N_i(E_j)$ the density of states, $\Sigma_i\Sigma_j f_i(E_j)$ the Fermi distribution, and m* the effective mass. The expression on the right hand side of Eq. (2) assumes that the density of states in the conduction band is parabolic and approximates the Fermi function by the Boltzmann distribution because the work function is much larger than $\kappa T_C$. If the effective mass is isotropic, then under both the thermalization and the photoexcitation processes of electrons above the conduction-band minimum, electrons gain an excessive degree of freedom with kinetic variation, such as $E_{i,j}-E_C=m^*[v^2]_{i,j}/2$, where $[v^2]_{i,j}=[v_x^2+v_y^2+v_z^2]_{i,j}$. The integral can then be rewritten in terms of electron velocities:

$$J_C = 2e\left(\frac{m^*}{h}\right)^3 \sum_i \sum_j \exp\left[\frac{-(E_C - E_{F,n_{i,j}})}{kT_C}\right] \cdot \left[\int_0^\infty dv_y \int_0^\infty dv_z \int_{v_{vac}}^\infty dv_x v_x \cdot \exp\left(\frac{m^* v^2}{2kT_C}\right)\right]_{i,j} \quad (3)$$

where $v_{vac}=\sqrt{2\chi/m^*}$ is the minimum velocity necessary to emit into vacuum. The excitation and thermalization processes of electrons require substantially more energy than the bandgap energy ($E_{gI}$ . . . $E_{gM}$) for even deep level transitions, as shown in FIG. 8. The incident gamma-rays or high-energy alpha and beta particles increase the electron population by both thermalization and photon-coupling above the conduction band minimum. These photo-excited and thermalized electron populations are effectively freed up to undergo a free-to-free transition away from band-gap structures ($E_g$, $E_{gI}$ . . . $E_{gM}$) of materials and exist in an open domain as a dark current. Therefore, the potential gap of electron population is further increased beyond the electron affinity, $\chi$, to migrate electrons in vacuum. The energies for level transitions can be expressed by the summation of bound-to-free ($E_C$) and free-to-free transitions ($\chi$), such as $E_C+\chi$ which is equal to $E_F+\phi_A$ for valence band, $E_I+\phi_I=E_C+\chi$ (Intra-band), and $E_M+\phi_M=E_C+\chi$ (Intra-band). Within the bandgap structures, $E_C$ can be expressed with the bandgap energy ($E_g$) on top of the Fermi energy at valence band and the Fermi energies ($E_{gI}$ . . . $E_{gM}$) for intra-bands. Since the conduction-band minimum ($E_C$) is within the free-to-free transition regime, $E_C \geq E_F+E_g$ for valence band and $E_C \geq E_I+E_{gI}$ and $E_C \geq E_M+E_{gM}$ for the intra-bands. Therefore, the work functions ($\phi$) of the system is determined by $\phi_A \geq E_g+\chi$ for valence band or $\phi_I \geq E_{gI}+\chi$ and $\phi_M \geq E_{gM}+\chi$ for intra-bands.

Significantly, Eq. (3) above yields a result that is identical to the Richardson-Dushman equation for thermionic current, except that the energy barrier in the exponent is relative to the quasi-Fermi level instead of the equilibrium Fermi level:

$$J_C = \left(\frac{4\pi e m^* k^2}{h^3}\right) T_C^2 \cdot \sum_i \sum_j \exp\left[\frac{-(E_C - E_{F,n} + \chi)}{kT_C}\right]_{i,j} = AT_C^2 \cdot \sum_i \sum_j \exp\left[\frac{-(\phi - (E_{F,n} - E_F)}{kT_C}\right]_{i,j} = AT_C^2 \cdot \sum_i \sum_j \exp\left[\frac{-\chi}{kT_C}\right]_{i,j} \quad (4)$$

where A is the Richardson-Dushman constant, 1202 $mA/mm^2K^2$. However, it is not clear whether a single value of the work function can be representative for this complex emission process. Since the second (level transition) and fourth terms (thermalization) are dominant contributors in Eq. (1), it is not obvious how these two terms should be presented in a closed form. The work function for both emission cases due to level transition and thermalization may not be a fixed value, but the density states in level transitions and thermalization may determine the work function. The expression on the right hand side of Eq. (4) explicitly shows that the effect of photo-illumination on semiconductor thermionic emission is to lower the energy barrier by the difference between the quasi-Fermi level with photoexcitation and the Fermi level without photoexcitation. Such an effect exists for deeper Fermi levels as expressed in Eqs. (1) and (4). Rewriting Eq. (4) in terms of the electron density in the conduction band, n, and average velocity perpendicular to the surface, $\langle v_x \rangle$, leads to $$J_C = \sum_i \sum_j e n_{i,j} \langle v_x \rangle_{i,j} \cdot \exp\left[\frac{-\chi}{kT_C}\right]_{i,j}. \quad (5)$$

Eq. (5) illustrates the number of electrons excited by the photo-coupling process and secondary, tertiary, etc. means which increases conduction-band electron concentration $\Sigma_i \Sigma_j n_{i,j}$ over the equilibrium value $n_{eq}$, whereas the thermal energy determines the rate at which electrons emit over the electron free-to-free transition in average, $\chi$. The current density shown in Eq. 5 represents a number of electrons emitted from emitter surface after the primary interaction. This process of estimation can be repeated over the secondary, tertiary, and so forth according to the use of photon energy.

The attenuation of high energy photons through a material usually follows the Beer-Lambert law. The transmittance of photons through a medium is described by $$T=e^{-\sigma \cdot \rho \cdot z}$$

where $\sigma$ is the attenuation cross-section of a medium, $\rho$ the density of a medium, and z the path length of the beam of light through a medium. The transmittance of high energy photons can be lowered as the cross-section of a material is large, or density is high or the path length is long, or by all factors working together. However, the cross section and density are determined by morphological formation of material. The only control parameter for the absorption of high energy photons is the thickness of material.

Figure 9:
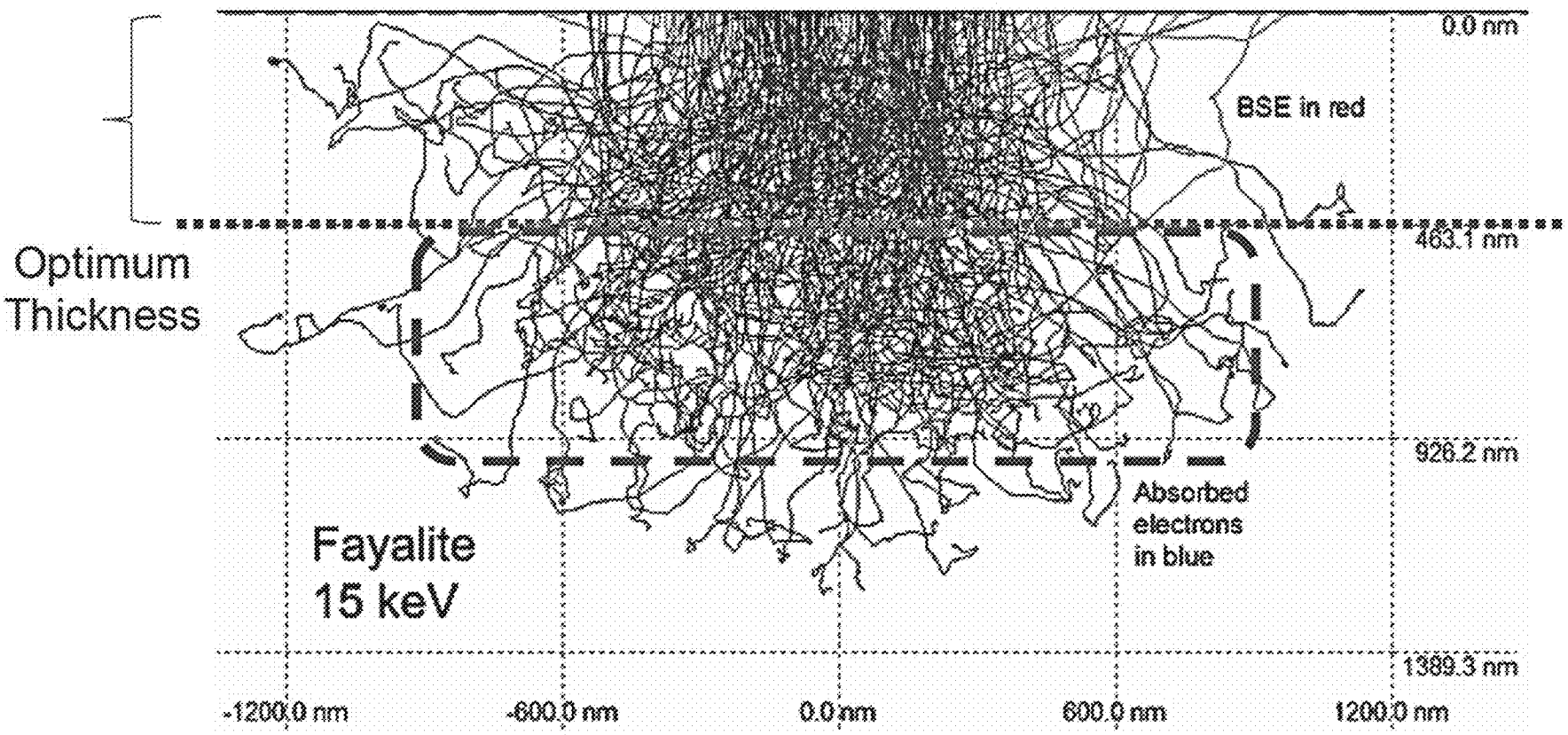
FIG. 9 depicts a simulation model of back-scattered electrons and multiplication of scattered electrons while 15 keV X-ray is incident on Fayalite as disclosed herein.

Specifically for the NTAC applications, the thickness of selected material cannot be increased only to improve the absorption of high energy photons. If the thickness of material is made too thick in order to absorb more high energy photons, the electrons liberated from the intra-band of atoms located deep inside material by high energy photons cannot be readily emitted out of the domain of material due to the loss of energy through multiple scatterings through Coulomb collisions. FIG. 1 illustrates that when Fayalite is illuminated by 15 keV X-ray, the back-scattered electrons that are emitted from the domain of material and the multiply scattered electrons, that remain within the domain, lose their kinetic energy by sequential Coulomb collisions, and are eventually recombined into the atomic structure. To maximize the number of emitted electrons, an optimal thickness of material must be estimated using a simulation model as depicted in FIG. 9. For example, Fayalite, as shown in FIG. 9, the optimum thickness for the maximum emission of electrons is set at a thickness of about 463.1 nm. As illustrated in FIG. 9, if the optimum thickness line is the domain boundary of material, a large number of those electrons liberated by high energy photons can migrate internally to reach at and cross over the optimum thickness line to escape the domain. This optimum thickness of a selected material is determined by the cross section of material for known high energy photons.

The left graph shown in FIG. 10 shows the test results for the absorption of X-ray through the gadolinium (Gd) plates that follows the Beer-Lambert law. The gadolinium disk sample used in experiment has a dimension of 1-inch diameter with 1/32 inch (20 gage) thickness. As shown in the right graph of FIG. 10, the incident X-ray photons interact with and liberate electrons of gadolinium atom. The liberated electrons that were emitted from the surface of gadolinium were measured as electrical current. The incident X-ray is absorbed by the first Gd plate and the rest goes to the $2^{nd}$ Gd plate through quartz insulator. In such a fashion, the $2^{nd}$, $3^{rd}$, etc., Gd plates in a linear array absorbs the rest of X-ray consecutively in a diminished order. This is an example of how consecutively high energy photons are absorbed by a linear array of Gd plates. By a certain number of layers, the transmission of high energy photons is completely diminished and ceased at the end Gd plate. The quartz plates placed between gadolinium plates have a role of insulator to prevent electrons from hopping from one Gd plate to another.

Figure 11:
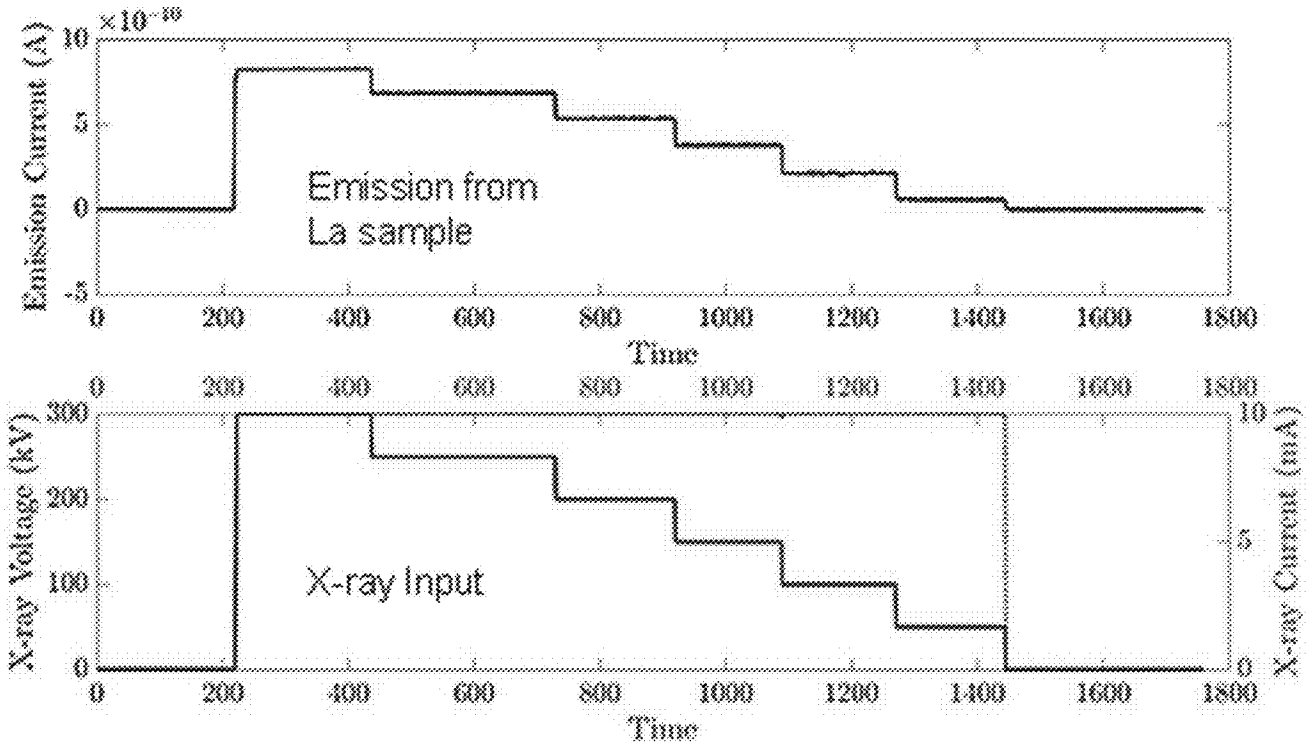
FIG. 11 graphically depicts electron emission from lanthanum with respect to X-ray input.
Figure 12:
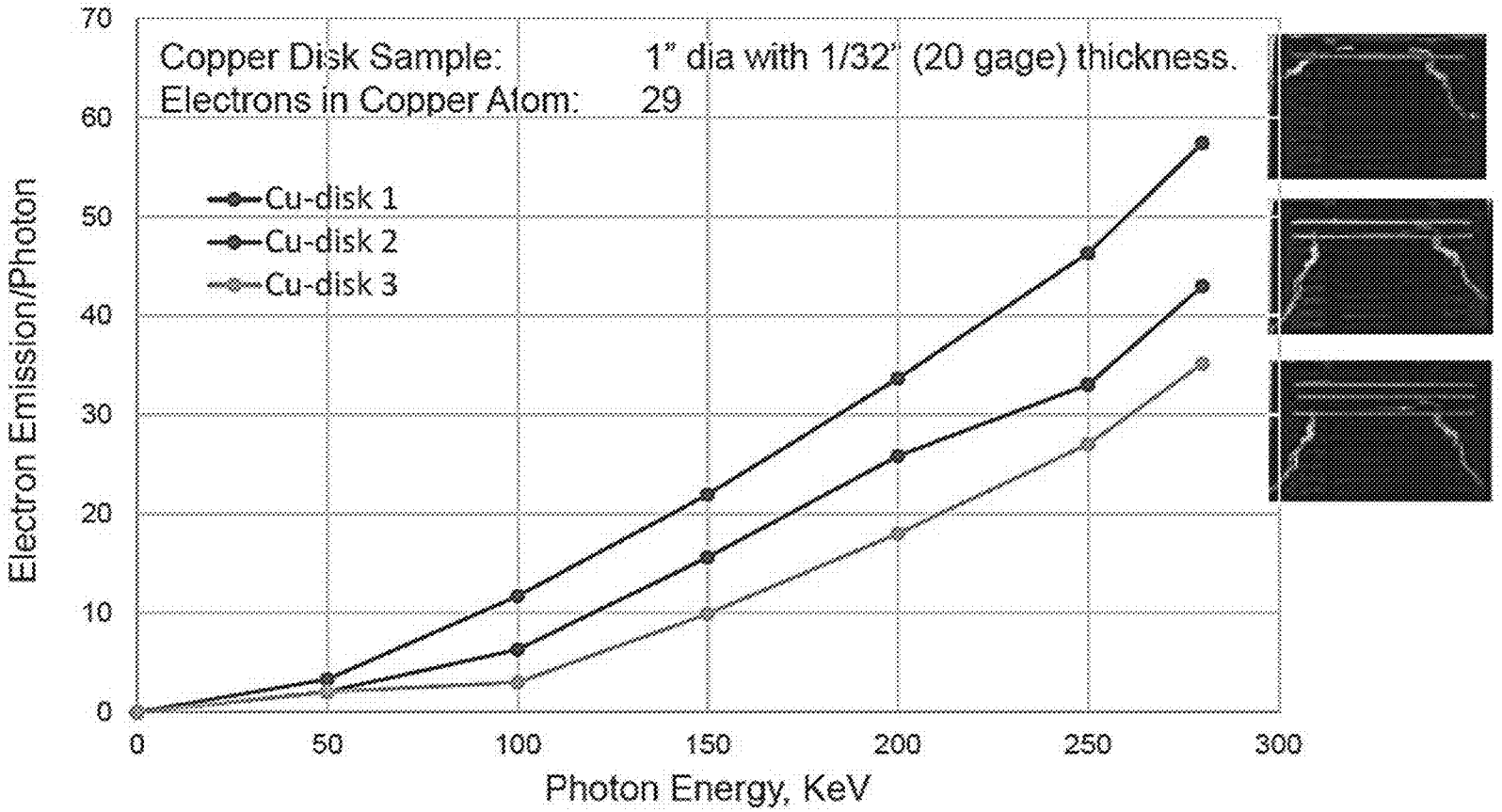
FIG. 12 graphically depicts electron emission from copper per photon.

Preliminary laboratory experiments were conducted for several electron emitter materials using a vacuum UV (VUV, 6~20 eV deuterium lamp) and a 320 keV X-ray source. The test result for lanthanum with VUV shows that the number of electrons extracted by VUV was 3.12 times more than electrons in the valence band alone. As shown in FIG. 11, the test conducted with 320 keV X-ray source for several electron emitter materials shows the proportional responses in electron emissions from materials along with the incident photon energy from 50 keV to 300 keV. The test results prove that the incident high energy photons liberate a large number of intra-band electrons through energy level transitions (bound-to-free and free-to-free). FIG. 12 shows the estimation of electron release per incident photon in copper disks using a CdTe sensor. The test results show limited or qualitative information since the CdTe sensor used does not have a capability to show the beam energy and profile.

Based upon the cross section calculation using the NIST XCOM database [8], the primary interaction of selected samples with γ-rays is estimated. Below, Table I shows how many NTAC layers required for the rhenium- or gold-based NTAC with performance based on the thickness of materials illustrated FIG. 13. The results are very promising since the estimation considered only primary interaction. As the theoretical model indicated above, if the secondary, tertiary, etc., interactions are included specifically for high γ-rays (>MeV), the overall performance will be much higher than that listed in Table I. For γ-ray with 1.25 MeV shown in Table I, the performance of electron emission is 11% for rhenium and 12% for gold emitter, respectively. Considering the secondary and tertiary effects, the performance with this photon energy (1.25 MeV) will be doubled or tripled by (a) the Compton scattering (γ-ray 1100 keV and $e^-$ 150 keV with 30° deflected angle) [4], (b) the energetic electron (150 keV) [5], (c) Fluorescent emission of X-ray (for rhenium case, $K_{\beta 1}$=69.298 keV and $L_{\beta 1}$=10.008 keV or at $K_{\alpha 1}$=61.131 keV and $L_{\alpha 1}$=8.651 keV [2]), and (d) the annihilation of pair (two photons of 511 keV minimum) [3]. This theoretical study based on γ-ray cross section provides a rough estimation of device performance and design criteria, but it is desirable to have a better model to figure out the secondary effects, including the density state of electrons in free-to-free transition within a domain considered. keV minimum) [3].

TABLE I

Electron emissions from Re & Au emitters under primary interactions with γ-

| Emitter Collector Insulator | Photon Energy (MeV) | Cross Section ($cm^2/g$) | Total Absorption (%) | PE Cross Section ($cm^2/g$) | PE Coupling (%) | PP Coupling (%) | (PE + PP)/Total (%) | NTAC Performance Layers | NTAC Performance Cascade (%) |
|---|---|---|---|---|---|---|---|---|---|
| Rhenium (75/186) | 0.6 | 1.045E−01 | 0.4826 | 4.062E−02 | 0.2260 | 0.0000 | 46.8 | 1 | 34.3% |
| | 1.25 | 5.462E−02 | 0.2914 | 8.687E−03 | 0.0533 | 0.0021 | 19 | 2 | 11.3% |
| | 7 | 4.369E−02 | 0.2408 | 6.096E−04 | 0.0038 | 0.1561 | 66.4 | 3 | 38.5% |
| Gold (79/197) | 0.6 | 1.118E−01 | 0.4769 | 4.828E−02 | 0.2441 | 0.0000 | 51 | 1 | 37.0% |
| | 1.25 | 5.612E−02 | 0.2777 | 1.038E−02 | 0.0584 | 0.0021 | 21.8 | 2 | 12.6% |
| | 7 | 4.485E−02 | 0.2289 | 7.234E−04 | 0.0042 | 0.1500 | 67.4 | 3 | 38.3% |

Theoretical analyses of an NTAC device can be carried out using MCNP-6 and GEANT-4 codes to set the definition and criteria for optimized NTAC device design parameters by mapping the emission potentials of high Z materials, density state analysis of intra-band electron transitions, and cross section analysis. Experimental analysis is essential to characterize and validate NTAC device design parameters and high-Z materials as emitters and low-Z materials for collector and insulator materials using 300 keV photons. Results can be used to define NTAC layers and to design a prototype NTAC for Cs-137 and Co-60.

Figure 13:
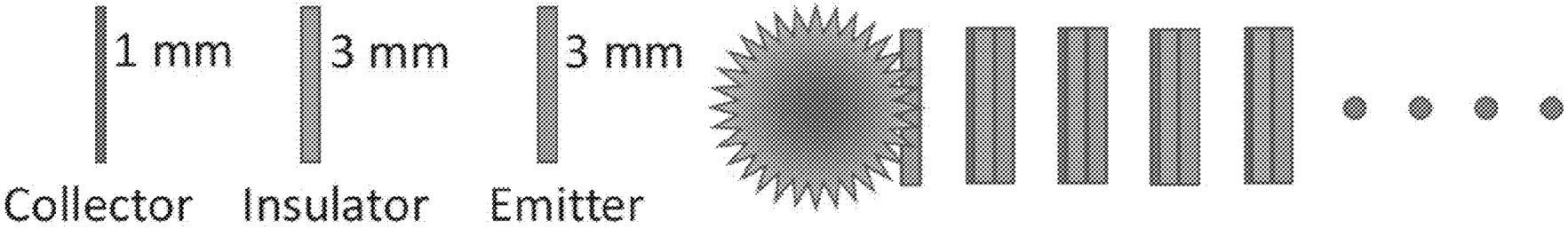
FIG. 13 illustrates the thickness of collector, insulator, and emitter materials.

The study performed for determining required NTAC layers with only primary interactions shows how many layers of NTAC are necessary to use the incident γ-ray without allowing any leaks (see Table II). The thicknesses of emitter, collector, and insulator used for the estimation of a number of layers required, without allowing the leak of γ-rays, are shown in FIG. 13. If the secondary, tertiary, etc., interactions are considered together, the number of NTAC layers will increase. Accordingly, it is necessary to optimize the required number of NTAC layers that contain and convert all γ-ray energy into output power using theoretical and experimental studies. This design approach greatly reduces the requisite γ-ray shielding for radioactivity. Proper selection of emitter, collector, and insulator are the key to optimized design to maximized electric power output of the NTAC layers.

TABLE II

NTAC layers without the leak of γ-rays

| Emitter | 0.6 MeV | 1.25 MeV | 7 MeV |
|---|---|---|---|
| La → Cu-$SiO_2$-La | 4 layers | 6 layers | 8 layers |
| Gd → Cu-$SiO_2$-Gd | 3 layers | 5 layers | 7 layers |
| Re → Cu-$SiO_2$-Re | 1 layers | 2 layers | 3 layers |
| Au → Cu-$SiO_2$-Au | 1 layers | 2 layers | 3 layers |

The cost of NTAC device development may be reduced by (1) the availability of radiation sources; (2) materials selection that optimizes the coupling efficiency with materials and the related thickness for emitter, collector, and insulator; and (3) the development of new fabrication technologies and operations.

Figure 15:
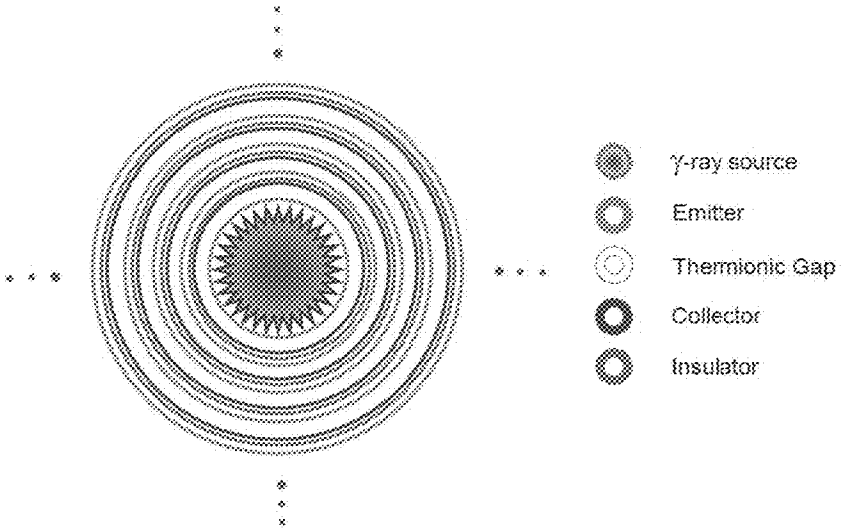
FIG. 15 illustrates an NTAC device as disclosed herein with multiple layers of combination of emitter, insulator, and collector.
Figure 14:
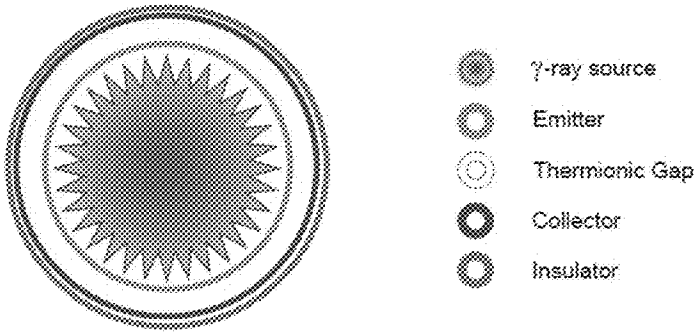
FIG. 14 illustrates an NTAC device with a combination of single emitter and collector as disclosed herein.

The design study of all power scale NTAC devices can be made with the results obtained from theoretical and experimental analyses as disclosed herein. Along with selected γ-radiation sources, NTAC design definitions and rules are established and implemented for the design of small-to-large scale NTAC systems. Design and performance analyses of a prototype NTAC device (1-kW$_e$ level) can be made within a year to set for fabrication ready. Relatively low photon energy sources (<1 MeV) require fewer NTAC layers with high Z material for emitters like that shown in FIG. 14 and Table II. For high energy photons (≥1 MeV), more NTAC layers are required in order to use all photon energy for useful power output without permitting any transmission through the last layer of NTAC. A cylindrical form of an NTAC configuration with a single layer is shown in FIG. 14 and a multi-layered device is depicted in FIG. 15. The thicknesses of emitter, collector, and insulator are also determined by the energy of the photon source, the selection of high Z-materials, and the maximum emission cut-off distance from the results of interaction patterns. The maximum emission cut-off thickness, as shown in FIG. 9, is determined by the electron population map within the emitter. If the emitter thickness is too large, some of the liberated low-energy electrons may fall into the recombination process, resulting in scintillation emission or exothermic settlement. Each of the radioisotope source, emitter, or collector may be at least 0.5 mm, 1 mm, 2 mm, 3 mm, 4 mm, or 5 mm thick. Each of the radioisotope source, emitter, or collector may be about 0.5-1 mm, 0.5-2 mm, 1-2 mm, 1-3 mm, 2-4 mm, 1-4 mm, or 0.5-5 mm thick.

Figure 16:
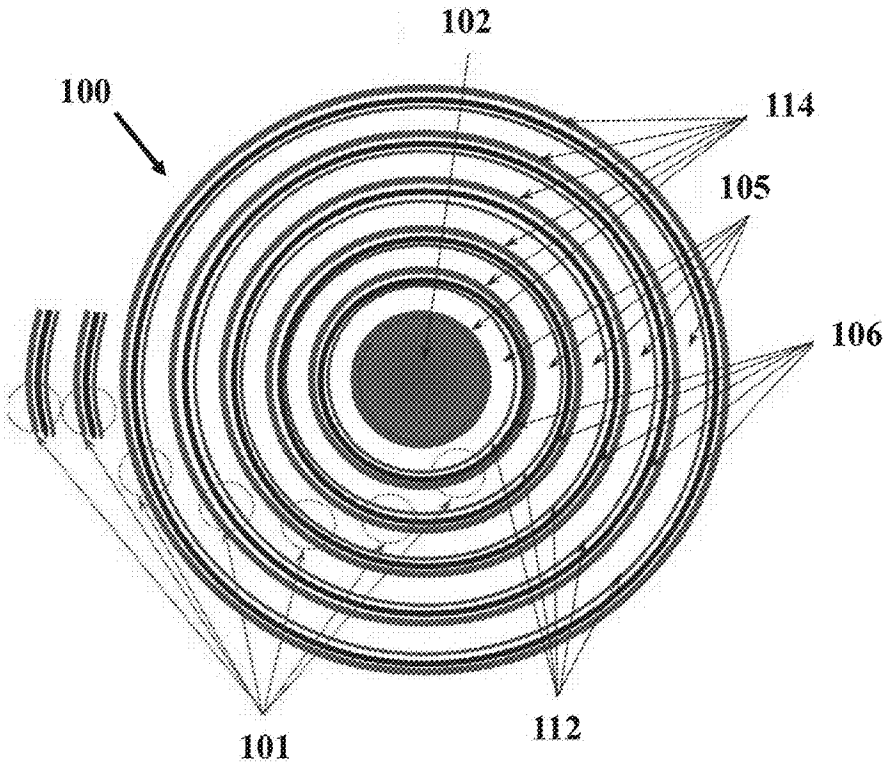
FIG. 16 illustrates the NTAC device concept with distributed thin radioisotope layers as disclosed herein. Thin layers of radioisotope and emitters reduce thermal loading due to multiple scattering of high energy photons and/or energetic beta particles in higher order interactions. There are top and bottom caps to seal the multi-layered NTAC (not shown).

As shown in FIG. 16, the NTAC system 100 may typically include a radioisotope core 102. In some examples the radioisotope or fuel may be Cobalt-60, Sodium-22, Cesium-137, nuclear waste, recycled nuclear waste, or other suitable nuclear fuel. The NTAC system may include insulators 106, collectors 112, and emitters 114. The NTAC device 100 may have radiation shielding layers encapsulating the device 100.

As also shown in FIG. 16, NTAC layers 101 may be separated by vacuum gaps 105. The core element 102 that emits γ-rays and/or beta particles may be co-axially arranged with the surrounding NTAC layers 101. One side of the radioisotope source 102 may be wrapped by a thin emitter layers 114 that capture high energy photon fluxes from the radioisotope layer 102 for the liberation of intra-band electrons. The collectors 112 may be positioned between the core 102 and the NTAC layers may be wrapped with the emitters 114 on one or both sides. The collectors 112 receive electrons released and crossed over the vacuum gap from the emitters. The collector 112 itself also receives and couples with incident γ-ray radiation and energetic electrons that might cause the electrons to be liberated from collector material too. A nanostructured emitting surface of high Z-material which has a large number of electrons within the shell structure of atom is selected for emitter 114, while the collector material 112 can be selected from a low or a mid Z material. Therefore, the number of liberated electrons from the emitter 114 arriving at the collector 112 overwhelms the liberated electrons from the collector. A large number of electrons liberated from emitter materials 114 are emitted from the nanostructured surface of emitter 114 and cross over the vacuum gap 105 and arrive at the collector surface 112. By the direct impingement of high energy photons, such as γ-ray transmitted through the emitter, X-ray fluorescence and the residue γ-ray as a remainder of Compton scattering, the collector 112 itself also undergoes liberating inner-shell electrons from the collector material. However, the number of energetic electrons arriving from emitters 114 at collectors 112 overwhelms the number of liberated electrons from collector. By forming a closed circuit between the emitter and the collector, the NTAC layer may include a power circuit that harnesses these supplant electrons from the collector to a load and the generation of an electrical current.

Specific elements of any of the foregoing embodiments or examples can be combined or substituted for elements in other embodiments or examples. Furthermore, while advantages associated with certain embodiments and examples of the disclosure have been described in the context of these embodiments, other embodiments and examples may also exhibit such advantages, and not all embodiments need necessarily exhibit such advantages to fall within the scope of the disclosure.

REFERENCES

[1] U.S. Pat. No. 10,269,463.

[2] McMaster, W. H., Kerr Del Grande, N., Mallett, J. H., and Hubbell, J. H., "Compilation of X-ray Cross Sections", Lawrence Livermore National Laboratory Report UCRL-50174 Section II Rev. I, 1969.

[3] Oakley, W. S, "Resolving the Electron-Positron Mass Annihilation Mystery", Int J of Sci Rep. Vol. 1, No. 6, pp. 250-252, 2015.

[4] "Energies of a photon at 500 keV and an electron after Compton scattering", https://en.wikipedia.org/wiki/Compton_scattering

[5] Johns, H. E., Till, J. E., and Cormack, D. V., "Electron Energy Distributions Produced by Gamma-Rays", Table 2a, Nucleonics, Vol. 12, No. 10, pp. 40-46, October, 1954.

[6] McMullan G, Faruqi A R, Henderson R, Guerrini N, Turchetta R, Jacobs A, van Hoften G, "Experimental observation of the improvement in MTF from backthinning a CMOS direct electron detector", Ultramicroscopy, 109 (9-3), pp. 1144-1147, August 2009.

[7] Sze, S. M. and Ng, K. K., Physics of Semiconductor Devices, 3rd Ed., Wiley Interscience, ISBN-13: 978-0-471-14323-9, p. 154, 2007.

[8] Berger, M. J., Hubbell, J. H., Seltzer, S. M., Chang, J., Coursey, J. S., Sukumar, R., Zucker, D. S., and Olsen, K., "XCOM: Photon Cross Sections Database", NIST Standard Reference Database 8 (XGAM), 1998.

What is claimed is:

1. A nuclear thermionic avalanche cell (NTAC) system comprising:

a radioisotope core configured to emit high energy photons wherein the radioisotope core is substantially cylindrical-shaped and wherein a radioisotope emitter layer surrounds an outer portion of the radioisotope core; and a plurality of NTAC layers surrounding the radioisotope core wherein the plurality of NTAC layers are substantially cylindrical-shaped and wherein the plurality of NTAC layers further comprise:

a collector;

an insulator; and an emitter, wherein the radioisotope emitter layer and the NTAC layer emitter are positioned facing the collector, wherein the collector is positioned across a thermionic vacuum gap, and wherein the collector, the insulator, and the emitter are integrated with each other wherein the collector is configured on an interior of the insulator and wherein the insulator is configured on an interior of the emitter;

wherein the plurality of NTAC layers form a coaxially arranged and multilayered NTAC;

wherein the radioisotope emitter and the NTAC emitter layers are configured to capture the photons from the radioisotope core, and by the captured photons free up a number of electrons in an avalanche process from deep and intra-bands of atoms; and wherein the number of avalanche electrons that are emitted from the emitter passes through the thermionic vacuum gap and arrive at the collector to output a high density avalanche cell current through a photo-ionic or thermionic process of the freed up electrons.

2. The system of claim 1, wherein the radioisotope core has a diameter and a height that are dependent on the design of the NTAC system according to power requirement.

3. The system of claim 1, wherein the photons are x-rays, gamma rays, or visible UV light.

4. The system of claim 1, wherein the radioisotope core is Cobalt-60, Sodium-22, or Cesium-137.

5. The system of claim 1, wherein a required number of NTAC layers is determined by the complete absorption and exhaustion of high energy photons undergoing the electron avalanche process through the plurality of NTAC layers.

6. The system of claim 1, wherein the emitter comprises a nanostructured surface of a high Z material.

7. The system of claim 1, wherein the emitters capture photons from the radioisotope core, and wherein the collectors are configured to capture avalanche electrons from the emitters and lead avalanche electrons to a power circuit.

8. The system of claim 1, wherein the collector comprises a low or mid Z material.

9. The system of claim 1, wherein the emitter has a thickness from about 1 mm to about 3 mm.

10. The system of claim 1, wherein the emitter has a thickness of at least 1 mm.

11. The system of claim 3, wherein photons, x-rays, gamma rays, or visible UV light are absorbed by the emitters and collectors and converted into thermal energy through inelastic collisions and scattering, and/or wherein the avalanche electrons undergo multiple Coulomb collisions with neighboring electrons generating thermal energy, and wherein a thermoelectric generator is configured to receive the thermal energy and output thermoelectric power.

12. A method of capturing high energy photons to generate power comprising:

receiving high energy photons emitted from a radioisotope core integrated with a nuclear thermionic avalanche cell (NTAC), wherein the NTAC comprises a plurality of NTAC layers configured to receive the photons, wherein the NTAC layer includes an emitter, a thermionic vacuum gap, and a collector, wherein the emitter is positioned between the radioisotope core and the collector;

outputting avalanche electrons using the received photons;

guiding the avalanche electrons to cross over a vacuum gap to a collector;

harnessing a load from the electrons at the collector via a power circuit; and generating an electrical current.

13. The method of claim 12, wherein the radioisotope core further comprises an emitter layer, thermionic vacuum gap, and a collector layer.

14. The method of claim 13, wherein the first emitter layer may have a thickness of at least 1 mm.

15. The method of claim 12, wherein the photons are x-rays, gamma rays, or visible UV light.

16. The method of claim 12, wherein the radioisotope core is Cobalt-60, Sodium-22, or Cesium-137.

17. The method of claim 12, wherein the emitter has a thickness from about 1 mm to about 3 mm.

18. The method of claim 12, wherein the emitter has a thickness of at least 3 mm.

19. The method of claim 12, wherein the emitter comprises a nanostructured surface of a high Z material.

20. The method of claim 12, wherein the collector comprises a low or mid Z material.

21. An energy conversion system comprising:

a radioisotope core configured to emit high energy photons, wherein the radioisotope core comprises Cobalt-60, Sodium-22, or Cesium-137;

a nuclear thermionic avalanche cell (NTAC) comprising a plurality of NTAC layers integrated with the radioisotope core and configured to receive the photons from the radioisotope core and by the received photons free up a number of electrons in an avalanche process from deep and intra-bands of an atom to output a high density avalanche cell current through a photo-ionic or thermionic process of the freed up electrons, and wherein the avalanche current is fed through power circuit wherein the plurality of NTAC layers comprise a nanostructured surface of a high Z material, wherein the plurality of NTAC layers comprise a combination of a collector wherein the collector is at least 1 mm thick, an insulator wherein the insulator is at least 3 mm thick, and an emitter wherein the emitter is at least 3 mm thick; and a thermoelectric generator configured to receive the thermal energy, wherein the thermal energy is radiatively conducted axially and radially, and output thermoelectric power, and wherein the thermoelectric generator surrounds the plurality of NTAC layers and the radioisotope core.

* * * * *